US010087669B1

(12) United States Patent
Gnadinger et al.

(10) Patent No.: US 10,087,669 B1
(45) Date of Patent: Oct. 2, 2018

(54) FRONT DOOR ASSEMBLY FOR BEVERAGE DISPENSER

(71) Applicant: Grindmaster Corporation, Louisville, KY (US)

(72) Inventors: Errin Whitney Gnadinger, Louisville, KY (US); Gregory K. Thompson, Finchville, KY (US); Brandon Kristopher Shell, Louisville, KY (US)

(73) Assignee: Grindmaster Corporation, Louisville, KY (US)

( * ) Notice: Subject to any disclaimer, the term of this patent is extended or adjusted under 35 U.S.C. 154(b) by 91 days.

(21) Appl. No.: 15/286,710

(22) Filed: Oct. 6, 2016

Related U.S. Application Data

(60) Provisional application No. 62/239,031, filed on Oct. 8, 2015.

(51) Int. Cl.
*E05F 3/22* (2006.01)
*B67D 1/00* (2006.01)
(Continued)

(52) U.S. Cl.
CPC ..... *E05F 3/224* (2013.01); *B67D 1/0021* (2013.01); *B67D 1/0042* (2013.01); *E05D 7/00* (2013.01);
(Continued)

(58) Field of Classification Search
CPC ... E05F 3/224; E05F 15/53; E05F 5/10; E05F 1/1091; E05F 1/1292; E05F 1/1058; E05F 3/02; E05F 1/08; E05F 1/10; E05F 1/1008; E05F 1/1016; E05F 1/1025; E05F 1/1033; E05F 1/1041; E05F 1/105; E05F 1/1066; E05F 1/1075; E05F 1/1083; E05F 1/1246;
(Continued)

(56) References Cited

U.S. PATENT DOCUMENTS 3,266,670 A 8/1966 Brooks et al.
4,185,415 A * 1/1980 LaConte ..... E05D 3/06 49/248
(Continued)

OTHER PUBLICATIONS

Grindmaster-Cecilware, Operator Manual, Powdered Cappuccino Dispenser, Form #CW-316-01, Part #390-00014, 2016.
(Continued)

*Primary Examiner* — Hiwot E Tefera
(74) *Attorney, Agent, or Firm* — Stites & Harbison, PLLC; David W. Nagle, Jr.; James R. Hayne

(57) ABSTRACT

A front door assembly for a beverage dispenser includes a front door, a linkage subassembly, and a piston. The linkage subassembly includes: a first member having a distal end pivotally connected to a cabinet of the beverage dispenser and a proximal end; and a second member having a distal end pivotally connected to the front door and a proximal end pivotally connected to the first member at a position intermediate the distal end and the proximal end of the first member. The piston is pivotally connected to and extends between the front door and the proximal end of the first member, with the piston providing a force that, in combination with the linkage subassembly, creates a torque that partially offsets a weight of the front door, such that the piston effectively assists the user in moving the front door from a closed position to an open position.

20 Claims, 8 Drawing Sheets

(51) Int. Cl.
*E05F 15/53* (2015.01)
*E05D 7/00* (2006.01)
*E06B 3/38* (2006.01)

(52) U.S. Cl.
CPC ..... *E05F 15/53* (2015.01); *E06B 3/38* (2013.01); *B67D 2001/0091* (2013.01); *E05D 2700/04* (2013.01); *E05Y 2201/218* (2013.01); *E05Y 2201/622* (2013.01); *E05Y 2900/608* (2013.01)

(58) Field of Classification Search
CPC ..... E05F 1/1253; E05F 1/1261; E05F 1/1269; E05F 1/1276; E06B 3/38; E05D 7/00; E05D 2700/04; E05D 3/12; E05D 3/122; E05D 3/125; E05D 3/127; E05D 3/183; E05D 3/186; E05D 2003/163; B67D 1/0042; B67D 1/0021; B67D 2001/0091; E05Y 2201/416; E05Y 2201/256; E05Y 2201/622; E05Y 2201/218; E05Y 2900/608; Y10T 16/53834; Y10T 16/281; Y10T 16/62; Y10T 16/2788; Y10T 16/53885; F24C 15/023; F25D 2323/024
USPC ..... 16/70, 289; 49/386, 387, 246–249; 312/326–329, 325, 319.1, 319.2, 319.4
See application file for complete search history.

(56) References Cited

U.S. PATENT DOCUMENTS 4,366,920 A 1/1983 Greenfield, Jr. et al.
5,339,494 A * 8/1994 Esau ..... E05D 3/145 16/233
5,394,651 A * 3/1995 Vial ..... E05F 15/53 49/340
5,564,592 A * 10/1996 Martin ..... B67D 1/06 220/254.3
5,881,917 A * 3/1999 Jones ..... B67D 1/06 200/82 R
5,882,099 A * 3/1999 Salice ..... E05D 15/262 160/207
6,041,548 A * 3/2000 Miller ..... E05F 1/1091 16/366
6,397,434 B1 * 6/2002 Cheal ..... E05D 3/145 16/289
7,047,600 B2 * 5/2006 Muir ..... E05D 15/30 16/346
D559,096 S * 1/2008 Hori ..... D8/400
2002/0108311 A1 * 8/2002 Salice ..... E05D 15/262 49/371
2006/0282983 A1 * 12/2006 Zetti ..... E05D 3/16 16/287
2008/0115322 A1 * 5/2008 Migli ..... E05D 15/46 16/283
2008/0134464 A1 * 6/2008 Salice ..... E05F 1/1058 16/84
2008/0172833 A1 * 7/2008 Migli ..... E05D 15/40 16/277
2008/0189906 A1 * 8/2008 Resnik ..... E05D 3/16 16/54
2008/0196314 A1 * 8/2008 Stratten ..... B62D 33/0273 49/386
2009/0072551 A1 * 3/2009 Hirtsiefer ..... E05D 3/14 292/223
2009/0139141 A1 * 6/2009 MacLeod ..... E05F 1/1091 49/21

OTHER PUBLICATIONS

Grindmaster-Cecilware, Operator Manual, Compact Powdered Beverage Dispenser, Form #CW-318-01, Part #390-00015, 2016.
Grindmaster-Cecilware, Operator Manual, Powdered Beverage Dispenser, Form #CW-314-01, Part #390-00013, 2016.
Grindmaster-Cecilware, Operator Manual, Powdered Beverage Dispensers, Form #CW-335-06, Part #390-00078, 2016.

* cited by examiner

FRONT DOOR ASSEMBLY FOR BEVERAGE DISPENSER

CROSS-REFERENCE TO RELATED APPLICATIONS

The present application claims priority to U.S. Patent Application Ser. No. 62/239,031 filed on Oct. 8, 2015, the entire disclosure of which is incorporated herein by reference.

BACKGROUND OF THE INVENTION

The present invention pertains to a beverage dispenser for the preparation and dispensing of a beverage, and, more particularly, to a front door assembly for such a beverage dispenser.

Beverage dispensers, characterized by having a powdered flavorant hopper from which a certain amount of powdered flavorant is mixed with a predetermined amount of water to produce a beverage that is dispensed upon demand, are well-known in the industry. Typically, the working components of the beverage dispenser are contained within a cabinet to prevent contamination and to protect the working components of beverage dispenser, but it is frequently necessary to access the interior portion of such a beverage dispenser, for example, to refill or replace a powdered flavorant hopper or to perform other cleaning and maintenance tasks. A front door assembly which easily opens and closes with minimal effort would therefore be advantageous.

SUMMARY OF THE INVENTION

The present invention is a front door assembly for a beverage dispenser.

A beverage dispenser includes a plurality of beverage dispensing units arranged in parallel and enclosed in a cabinet, along with all of the other components of the beverage dispenser. Thus, the cabinet, in combination with a front door assembly, collectively encloses the plurality of beverage dispensing units. In order to access the beverage dispensing units, a front door assembly includes a front door that is pivotally connected to a top panel of the cabinet by a hinge, such that the front door is movable between a closed position and an open position relative to the cabinet.

An exemplary front door assembly made in accordance with the present invention includes a linkage subassembly and a piston configured to assist in opening the front door. The linkage subassembly is positioned adjacent to one side of the front door. In some embodiments, the linkage subassembly includes a first member operably connected to the cabinet and a second member operably connected to and extending between the front door of the beverage dispenser and the first member. More specifically, the first member has a distal end pivotally connected to the cabinet of the beverage dispenser, and the first member has a proximal end opposite the distal end. The second member has a distal end pivotally connected to the front door and a proximal end opposite the distal end. The proximal end of the second member is pivotally connected to the first member at a position intermediate the distal end and the proximal end of the first member.

The piston is pivotally connected to and extends between the front door and the proximal end of the first member, and the piston provides a force such that, when a user moves the front door from the closed position to the open position, the force provided by the piston, in combination with the linkage subassembly, creates a torque that partially offsets a weight of the front door, such that the piston effectively assists the user in moving the front door from the closed position to the open position.

With respect to the operation of the front door assembly, when the front door is in a closed position, the piston extends substantially parallel to the front door and is in a compressed state. The first member extends downward and away from the cabinet at a predetermined acute angle relative to the cabinet, and the second member an initial acute angle relative to the front door. In the closed position, the piston is applying a force that acts on the proximal end of the first member and the front door, but, because of the configuration of the linkage subassembly, the piston cannot overcome the weight of the front door and the piston remains in the compressed state. In other words, the force provided by the piston, in combination with the linkage subassembly, does not generate a sufficient torque to open the front door.

When the front door is in the open position, the piston is now in an extended state. Furthermore, the first member extends upward and away from the cabinet at a predetermined obtuse angle relative to the cabinet, and, as a result of the movement of the first member from the predetermined acute angle to the predetermined obtuse angle, the second member has moved from the initial acute angle to a final acute angle relative to the front door.

The force provided by the piston is a substantially constant force, but, as mentioned above, when the front door is in the closed position, the configuration of the linkage subassembly is such that the force of the piston is unable to lift the front door. The front door must be partially opened before there is sufficient mechanical advantage provided by the linkage subassembly that the piston can provide a torque that partially counteracts the weight of the front door, and thus assists a user in opening the front door. When the front door is in the open position, however, the configuration of the linkage subassembly is such that the force provided by the piston, in combination with the linkage subassembly, creates a torque that fully offsets the weight of the front door, such that the piston maintains the front door in the open position.

When the front door is in the open position, the linkage assembly (i.e., the first member and the second member), and piston are all maintained substantially within the confines of the front door. This provides for substantially unobstructed access to the interior of the cabinet for a user to, for example, refill or replace a powdered flavorant hopper or to perform other cleaning and maintenance tasks.

In some embodiments, a second linkage subassembly and a second piston is positioned on an opposite side of the front door. When a user moves the front door from the closed position to the open position, the first force provided by the first piston, in combination with the first linkage subassembly, as well as the second force provided by the second piston, in combination with the second linkage subassembly, creates a torque that partially offsets a weight of the front door, such that the first and second pistons effectively assist the user in moving the front door from the closed position to the open position.

DETAILED DESCRIPTION OF THE INVENTION

The present invention is a front door assembly for a beverage dispenser. In particular, the front door assembly of the present invention assists a user in moving the front door from a closed position to an open position, and further provides easy access to the interior of the cabinet when the front door is in the open position.

Figure 1:
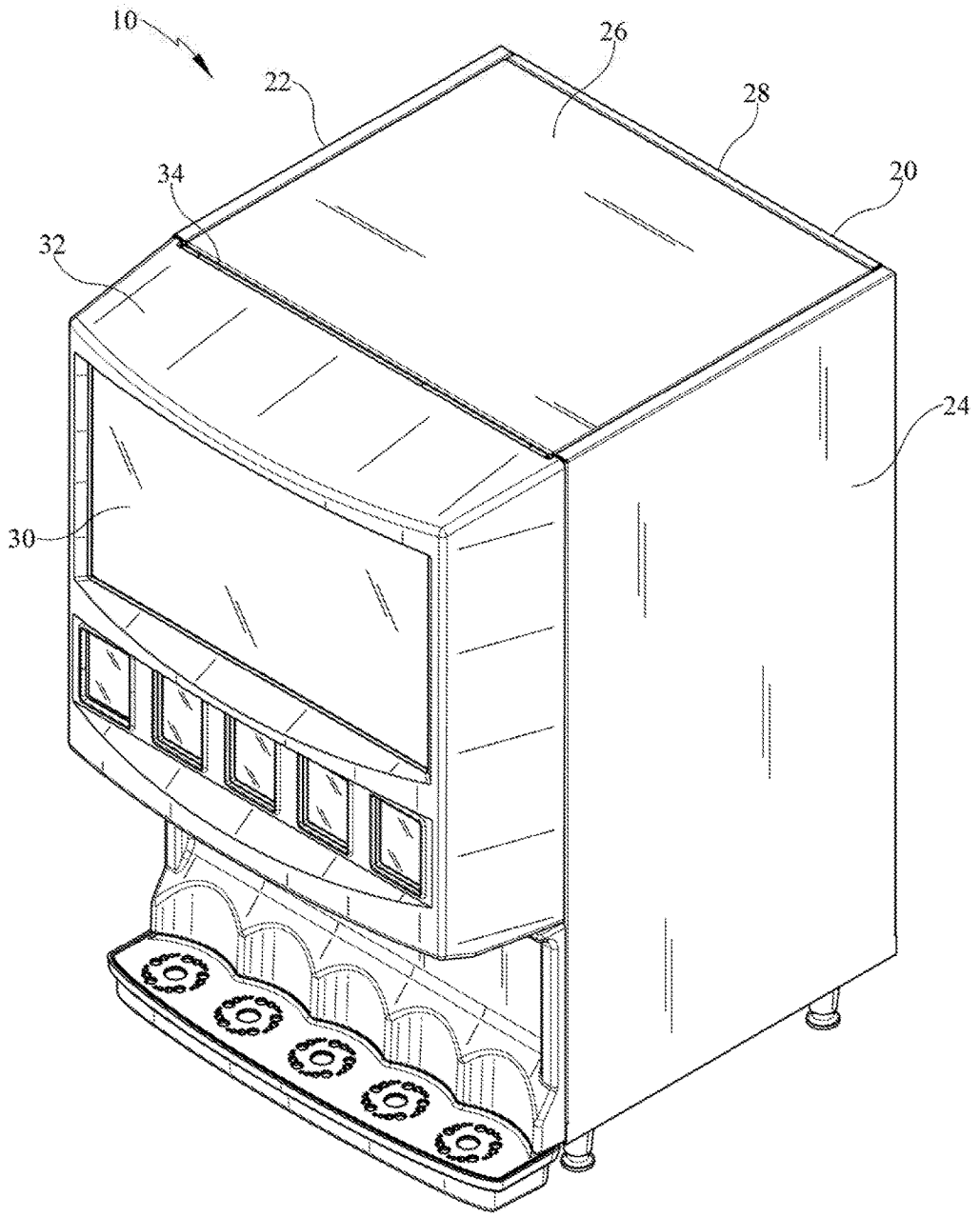
FIG. 1 is a perspective view of an exemplary beverage dispenser that includes a front door assembly made in accordance with the present invention.
Figure 2:
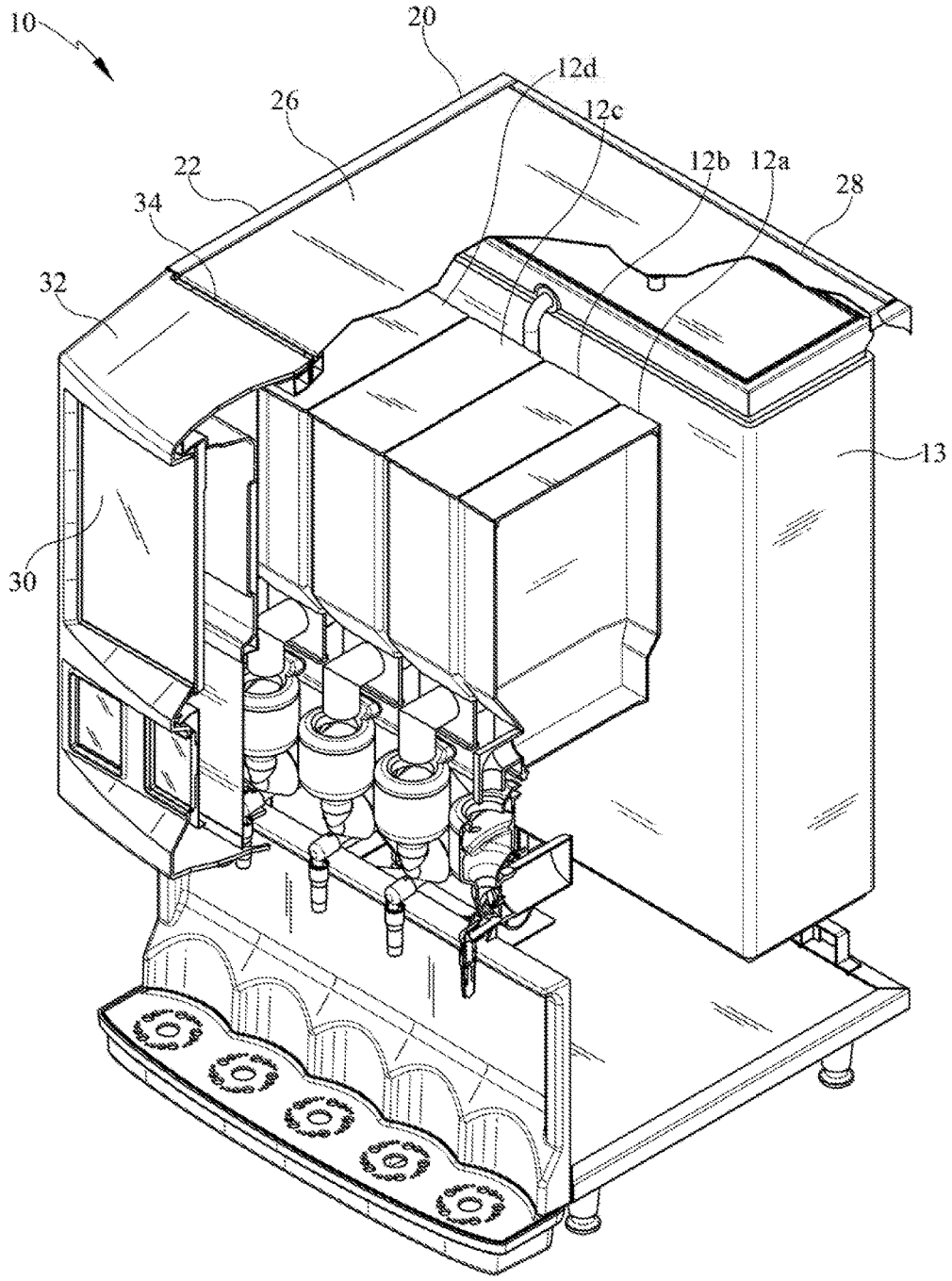
FIG. 2 is a partial cutaway view of the beverage dispenser of FIG. 1 showing a plurality of beverage dispensing units within the beverage dispenser.

Referring first to FIGS. 1 and 2, an exemplary beverage dispenser 10 includes a plurality of beverage dispensing units 12*a-d* arranged in parallel and enclosed in a cabinet 20, along with all of the other components of the beverage dispenser 10. As is common in beverage dispensers for mixing a powdered flavorant with water, a reservoir 13 is connected by a valve and water line to a source of water (not shown). The reservoir 13 is then connected to each beverage dispensing unit 12*a-d* via a pump in order to provide a readily available source of water to each beverage dispensing unit 12*a-d* at a predetermined pressure and flow rate.

Referring still to FIGS. 1 and 2, in this exemplary embodiment, the cabinet 20 includes a left panel 22, a right panel 24, a top panel 26, and a rear panel 28. The panels 22, 24, 26, 28 of the cabinet 20, in combination with a front door assembly 30, collectively enclose the plurality of beverage dispensing units 12*a-d*, the reservoir 13, and other components of the beverage dispenser 10. In order to access the beverage dispensing units 12*a-d*, a front door 32 of the front door assembly 30 is pivotally connected to the top panel 26 of the cabinet 20 by a hinge 34, such that the front door 32 is movable between a closed position and an open position relative to the cabinet 20, as discussed further below.

Referring now to FIGS. 3A-3C and 4, in addition to the front door 32, the front door assembly 30 of the present invention also includes a linkage subassembly and a piston 70 configured to assist in opening the front door 32. In FIGS. 3A-3C and 4, the linkage subassembly is positioned adjacent to a first side of the front door 32, which corresponds to the left panel 22 of the cabinet 20. The linkage subassembly includes: a first member 50 operably connected to the left panel 22 of the cabinet 20; and a second member 60 operably connected to and extending between the front door 32 of the beverage dispenser 10 and the first member 50. More specifically, the first member 50 has a distal end 54 pivotally connected to the cabinet 20 of the beverage dispenser 10, and the first member 50 has a proximal end 52 opposite the distal end 54. The second member 60 has a distal end 64 pivotally connected to the front door 32 and a proximal end 62 opposite the distal end 64. The proximal end 62 of the second member 60 is pivotally connected to the first member 50 at a position intermediate the distal end 64 and the proximal end 62 of the first member 50, as further discussed below.

Referring still to FIGS. 3A-3C and 4, the piston 70 is pivotally connected to and extends between the front door 32 and the proximal end 52 of the first member 50, and the piston 70 provides a force such that, when a user moves the front door 32 from the closed position to the open position, the force provided by the piston 70, in combination with the linkage subassembly, creates a torque that partially offsets a weight of the front door 32, such that the piston 70 effectively assists the user in moving the front door 32 from the closed position to the open position.

Figure 3A:
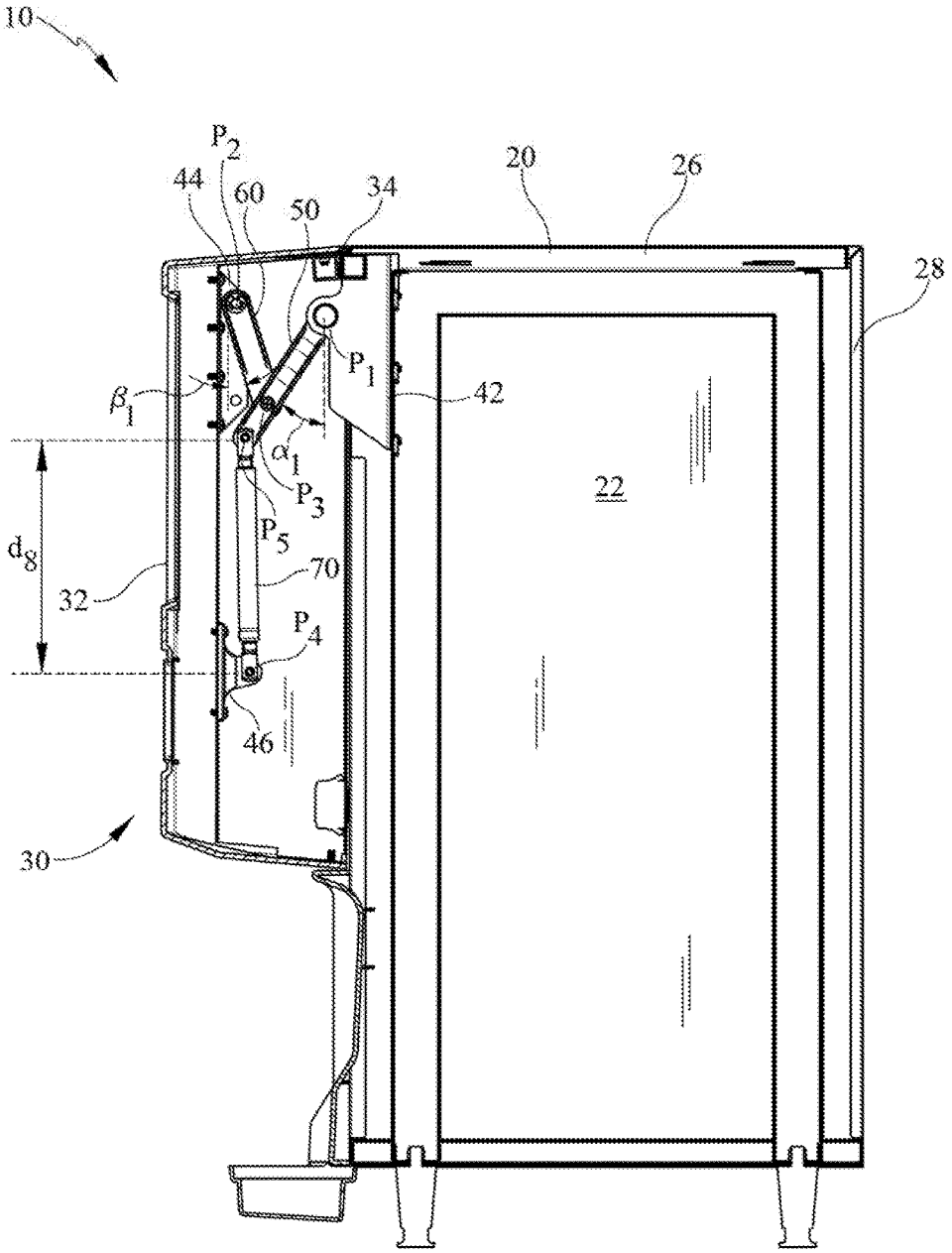
FIG. 3A is a side-sectional view of the beverage dispenser of FIG. 1 with the front door in a closed position.
Figure 3B:
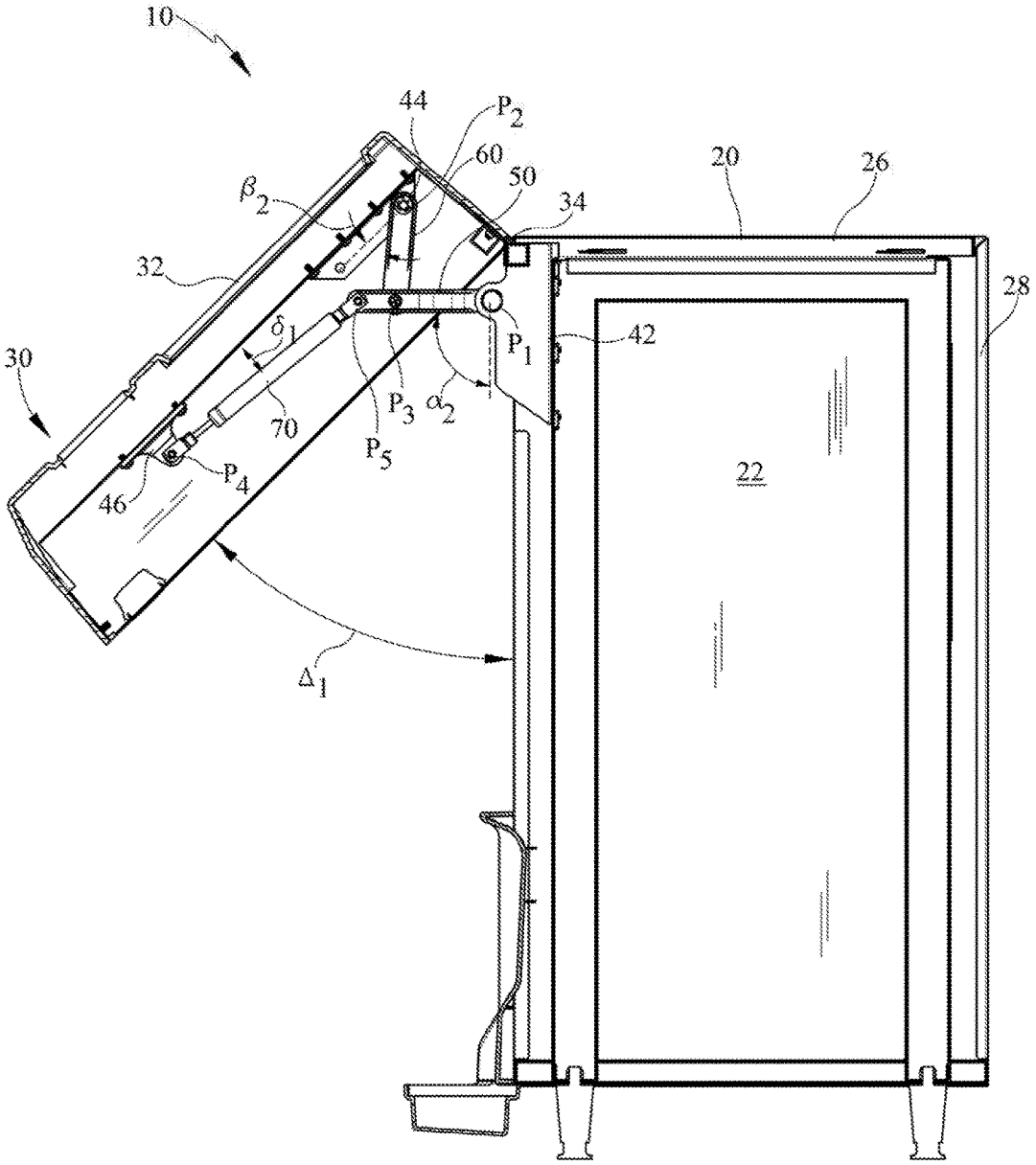
FIG. 3B is a side-sectional view similar to FIG. 3A, but with the front door in a partially open position.
Figure 3C:
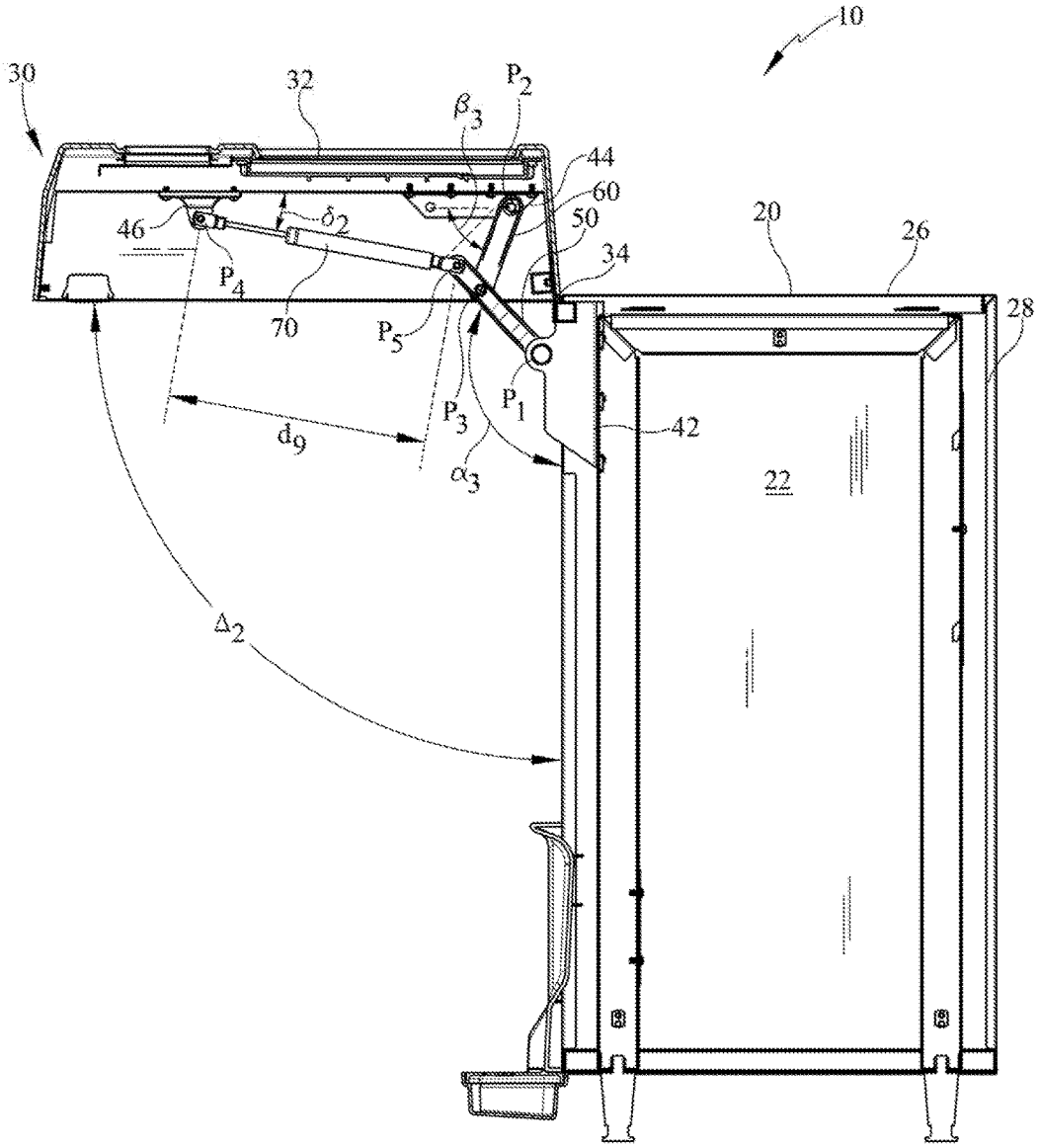
FIG. 3C is a side-sectional view similar to FIG. 3A, but with the front door in an open (or fully open) position.
Figure 4:
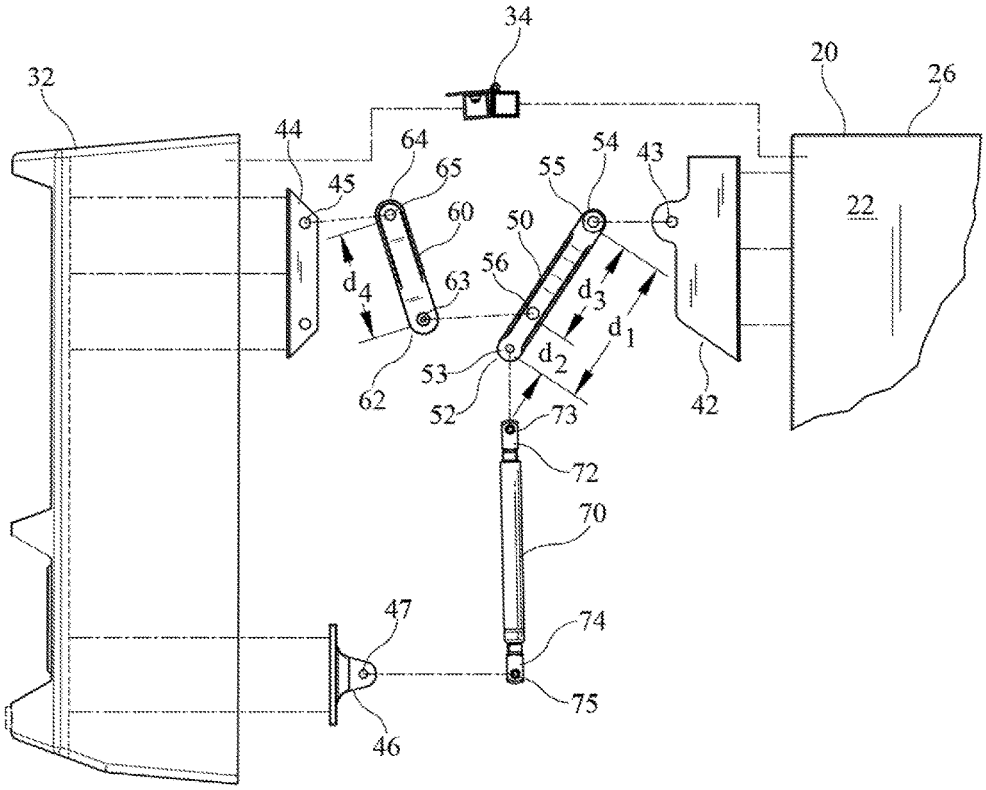
FIG. 4 is an exploded side view of the front door assembly shown in FIGS. 3A-3C.

Referring now to FIGS. 3A-3C and 4, the first member 50 is an elongated member that defines a proximal hole 53 at its proximal end 52 and defines a distal hole 55 at its distal end 54. A central hole 56 is also defined by the first member 50 and positioned intermediate the proximal end 52 and the distal end 54 of the first member 50. As shown in FIG. 4, the distal hole 55 is positioned at a distance, $d_1$, of about 4.5 inches away from the proximal hole 53. The central hole 56 is positioned at a distance, $d_2$, of about 1.25 inches away from the proximal hole 53 and a distance, $d_3$, of about 3.25 inches away from the distal hole 55. The distal end 54 of the first member 50 is operably connected to the left panel 22 of the cabinet 20. In particular, a first member anchor 42 is mounted to the left panel 22 of the cabinet 20, with the first member anchor 42 defining a hole 43. The distal end 54 of the first member 50 is pivotally connected to the first member anchor 42 by aligning the distal hole 55 defined by the first member 50 with the hole 43 defined by the first member anchor 42 and then inserting a first pin P1 (shown in FIGS. 3A-3C) through the aligned distal hole 55 of the first member 50 and the hole 43 of the first member anchor 42.

Referring now to FIGS. 3A-3C and 4, the second member 60 is also an elongated member that defines a proximal hole 63 at its proximal end 62 and defines a distal hole 65 at its distal end 64. As shown in FIG. 4, the distal hole 65 is positioned a distance, $d_4$, of about 3.25 inches away from the proximal hole 63. The distal end 64 of the second member 60 is operably connected to the front door 32 of the beverage dispenser 10. In particular, a second member anchor 44 is mounted to the front door 32 of the beverage dispenser 10, and the second member anchor 44 defines a hole 45. The distal end 64 of the second member 60 is pivotally connected to the second member anchor 44 by aligning the distal hole 65 of the second member 60 with the hole 45 of the second member anchor 44 and then inserting a second pin P2 (shown in FIGS. 3A-3C) through the aligned distal hole 65 of the second member 60 and the hole 45 of the second member anchor 44. Similarly, the proximal end 62 of the second member 60 is operably connected to the first member 50 by aligning the proximal hole 63 defined by the second member 60 with the central hole 56 defined by the first member 50 and then inserting a third pin P3 (shown in FIGS. 3A-3C) through the aligned proximal hole 63 of the second member 60 and the central hole 56 of the first member 50.

Figure 5A:
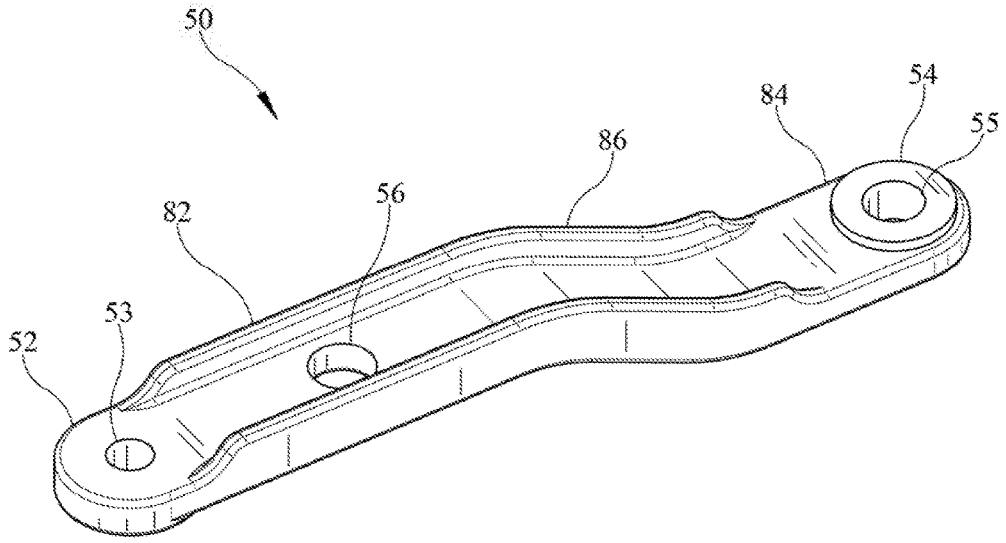
FIG. 5A is a perspective view of the first member of the linkage subassembly of FIG. 4.
Figure 5B:
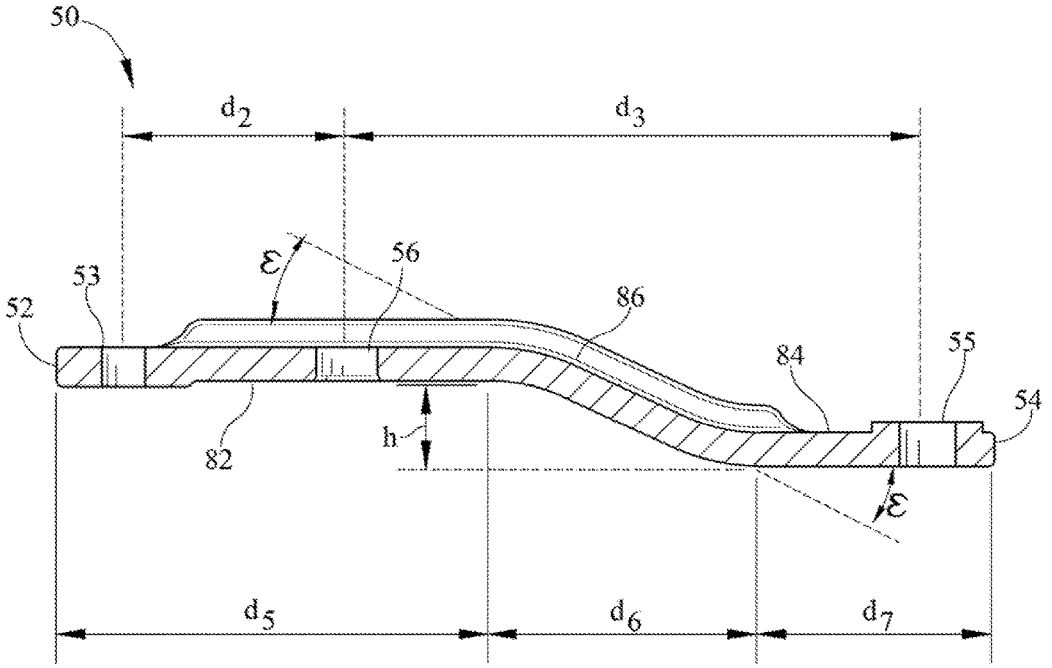
FIG. 5B is a side-sectional view of the first member of the linkage subassembly of FIG. 4.

Referring now to FIGS. 5A and 5B, in order to minimize the width of the linkage subassembly, the first member 50 is bent (or formed) such that the distal end 54 of the first member 50 moves in substantially the same plane as the distal end 64 of the second member 60. In particular, the first member 50 can be characterized as comprising: a horizontal first portion 82 that includes the proximal end 52, the proximal hole 53, and the central hole 56; a horizontal second portion 84 that includes the distal end 54 and the distal hole 55; and an angled portion 86 connecting the first portion 82 and the second portion 84. As perhaps best shown in FIG. 5B, because of the angled portion 86, the second portion 84 of the first member 50 is parallel to the first portion 82 of the first member 50, but is not within the same plane as the first portion 82 of the first member 50. In this exemplary embodiment, the first portion 82 has a length, $d_5$, of about 2.424 inches long, the second portion 84 has a length, $d_7$, of about 1.317 inches long, and the angled portion 86 has a length, $d_6$, of about 1.509 inches long. The angled portion 86 is oriened at an angle, ε, of about 25° relative to both the first portion 82 and the second portion 84. This creates a gap having a height, h, of about 0.481 inches into which the proximal end 62 of the second member 60 fits when connected to the first member 50. In other words, the proximal end 62 of the second member 60 is pivotally connected to the first portion 82 of the first member 50, such that the second member 60 is in substantially the same plane as the second portion 84 of the first member 50.

Referring again to FIGS. 3A-3C and 4, the piston 70 is a typical gas piston (or gas spring) that provides a substantially constant force that resists compression of the piston 70. Furthermore, in this exemplary embodiment, the piston 70 has a U-shaped proximal end 72 (or mount) that defines a pair of aligned proximal holes 73 (one of which is viewable in FIGS. 3A-3C and 4), along with a U-shaped distal end 74 (or mount) opposite the proximal end 72 that defines a pair of aligned distal holes 75 (one of which is viewable in FIGS. 3A-3C and 4). The piston 70 has a length between the proximal holes 73 and the distal holes 75 of the piston 70, which is variable from a minimum length, $d_8$, of about 7.27 inches (compressed state) to a maximum length, $d_9$, of about 9.97 inches (extended state), as further discussed below.

Referring still to FIGS. 3A-3C and 4, the distal end 74 of the piston 70 is pivotally connected to the front door 32 of the beverage dispenser 10. In particular, a piston anchor 46 is mounted to the front door 32 of the beverage dispenser 10, and the piston anchor 46 defines a hole 47. The distal end 74 of the piston 70 is pivotally connected to the piston anchor 46 by positioning the piston anchor 46 within the U-shaped distal end 74 of the piston 70, aligning the distal holes 75 with the hole 47 defined by the piston anchor 46, and then inserting a fourth pin P4 (shown in FIGS. 3A-3C) through the aligned distal holes 75 and the hole 47 of the piston anchor 46.

Referring still to FIGS. 3A-3C and 4, the proximal end 72 of the piston 70 is pivotally connected to the proximal end 52 of the first member 50 by positioning the proximal end 52 of the first member 50 within the U-shaped proximal end 72 of the piston 70, aligning the proximal holes 73 with the proximal hole 53 defined by the first member 50, and then inserting a fifth pin P5 (shown in FIGS. 3A-3C) through the aligned proximal holes 73 and the proximal hole 53 of the first member 50.

It should be noted that each of the pivotal connections described above can include, in addition to the pins P1-P5, one or more known methods of retaining the pins P1-P5 such as, for example, an e-clip style retaining ring. Furthermore, it is contemplated that one or more of the pins P1-P5 could be a threaded screw with threads that securely engage one of the respective holes of each pivotal connection while allowing free rotation of the other of the respective holes of the pivotal connection about the threaded screw. Of course, other forms of pivotal connections could also be used and incorporated into the front door assembly without departing from the spirit and scope of the present invention.

With respect to the operation of the front door assembly 30, and referring first to FIG. 3A, when the front door 32 is in a closed position, the piston 70 extends substantially parallel to the front door 32 and is in a compressed state, with a distance, $d_8$, of about 7.27 inches between the fourth pin P4 and the fifth pin P5 (i.e., between the proximal holes 73 and the distal holes 75 of the piston 70). In the closed position, the piston 70 is applying a force that acts on the proximal end 52 of the first member 50 and the piston anchor 46, but, because of the configuration of the linkage subassembly, the piston 70 cannot overcome the weight of the front door 32, and the piston 70 thus remains in the compressed state. In other words, the force provided by the piston 70, in combination with the linkage subassembly, does not generate a sufficient torque to open the front door 32. In this exemplary embodiment, in the closed position, the first member 50 extends downward and away from the first member anchor 42 (i.e., the cabinet 20) at a predetermined acute angle, $\alpha_1$, of about 33.4° relative to a vertical plane defined by the front face of the cabinet 20, and the second member 60 is oriened at an initial acute angle, $\beta_1$, of about 17.57° relative to a plane defined by the face of the front door 32.

Referring now to FIG. 3B, as a user opens the front door 32 (i.e., by pulling the lower edge of the front door 32 forward so that the front door 32 rotates about the hinge 34), the first member 50 begins rotating about the pivot axis defined by the first pin P1 (i.e., clockwise in FIG. 3B). As a result of such movement of the first member 50, the second member 60 begins rotating about the pivot axis defined by the second pin P2 (i.e., counterclockwise in FIG. 3B). During such movement, the force provided by the piston 70, in combination with the linkage subassembly, creates a torque that partially offsets the weight of the front door 32, such that the piston 70 effectively assists the user in opening and lifting the front door 32. In FIG. 3B, when the front door 32 has been partially open to an angle, $\Delta_1$, of about 45° relative to the vertical plane defined by the front face of the cabinet 20, the piston 70 is partially extended and now is oriened at a narrow angle, $\delta_1$, of about 10° or less relative to the plane defined by the face of the front door 32. Furthermore, the first member 50 has rotated to an angle, $\alpha_2$, of about 89.67° relative to the vertical plane defined by the front face of the cabinet 20, and the second member 60 has rotated to an angle, $\beta_2$, of about 40.05° relative to the plane defined by the face of the front door 32.

Referring now to FIG. 3C, when the front door 32 is in the open (or fully open) position, the first member 50 has further rotated about the pivot axis defined by the first pin P1 (i.e., clockwise in FIG. 3C), and the second member 60 has further rotated about the pivot axis defined by the second pin P2 (i.e., counter-clockwise in FIG. 3C). Specifically, when the front door 32 is in the open position, the front door 32 is at an angle, $\Delta_2$, of about 90° relative to the vertical plane defined by the front face of the cabinet 20. The piston 70 is now in an extended state, with a distance, $d_9$, of about 9.97 inches between the fourth pin P4 and the fifth pin P5 of the piston 70, and with the piston 70 forming a narrow angle, $\delta_2$, of about 20° or less relative to the plane defined by the face of the front door 32. Furthermore, the first member 50 extends upward and away from the first member anchor 42 (i.e., the cabinet 20) at a predetermined obtuse angle, $\alpha_3$, of about 147.610 relative to the vertical plane defined by the front face of the cabinet 20. And, as a result of the movement of the first member 50 from the predetermined acute angle, $\alpha_1$, to the predetermined obtuse angle, $\alpha_3$, the second member 60 has moved from the initial acute angle, $\beta_1$, to a final acute angle, $\beta_3$, of about 77.10 relative to the plane defined by face of the front door 32.

As described above, the force provided by the piston 70 is a substantially constant force, but, when the front door 32 is in the closed position, the configuration of the linkage subassembly is such that the force of the piston 70 is unable to lift the front door 32. The front door 32 must be partially opened before there is sufficient mechanical advantage provided by the linkage subassembly that the piston 70 can provide a torque that partially counteracts the weight of the front door 32, and thus assists a user in opening the front door 32. When the front door 32 is in the open position, however, the configuration of the linkage subassembly is such that the force provided by the piston 70, in combination with the linkage subassembly, creates a torque that fully offsets the weight of the front door 32, such that the piston 70 maintains the front door 32 in the open position. Of course, in order to close the front door 32, the user pushes down on the front door 32 to counteract and overcome the force of the piston 70.

Advantageously, and as shown in FIG. 3C, when the front door 32 is in the open position, the first member 50, the second member 60, and the piston 70 are all maintained substantially within the confines of the front door 32. This provides for substantially unobstructed access to the interior of the cabinet 20 for a user to, for example, refill or replace a powdered flavorant hopper or to perform other cleaning and maintenance tasks.

Furthermore, and as mentioned above, the first member 50 includes an angled portion 58 that creates a gap inches into which the proximal end 62 of the second member 60 fits when connected to the proximal end 52 of the first member 50. As a result of such a construction of the first member 50 and the second member 60, the linkage subassembly can be incorporated in the beverage dispenser 10 without any significant increase in the overall width of the beverage dispenser 10.

Although the previous discussion focuses only on one linkage subassembly positioned adjacent to a first side of the front door 32, which corresponds to the left panel 22 of the cabinet 20, it is contemplated that, in at least some embodiments, a second linkage subassembly (and piston) would be positioned on the other side of front door 32 and connected to the right panel 24 of the cabinet 20 and the front door 32 of the beverage dispenser 10.

In such embodiments, a first linkage subassembly substantially identical to the linkage subassembly described above is positioned adjacent to a first side of the front door (i.e., adjacent to the left panel of the cabinet similar to the linkage subassembly described above). The first linkage subassembly includes a first member having a distal end pivotally connected to the cabinet of the beverage dispenser and a proximal end opposite the distal end. The first linkage subassembly further includes a second member having a distal end pivotally connected to the front door and a proximal end opposite the distal end. The proximal end of the second member is pivotally connected to the first member of the first linkage subassembly at a position intermediate the distal end and the proximal end of the first member of the first linkage subassembly. Furthermore, a first piston is pivotally connected to and extends between the front door and the proximal end of the first member of the first linkage subassembly, with the first piston providing a first force.

In such embodiments, a second linkage subassembly is then positioned adjacent to second side of the front door (i.e., adjacent to the right panel of the cabinet). The second linkage subassembly includes a first member having a distal end pivotally connected to the cabinet of the beverage dispenser and a proximal end opposite the distal end. The second linkage subassembly further includes a second member having a distal end pivotally connected to the front door and a proximal end opposite the distal end. The proximal end of the second member is pivotally connected to the first member of the second linkage subassembly at a position intermediate the distal end and the proximal end of the first member of the second linkage subassembly. Furthermore, a second piston is pivotally connected to and extends between the front door and the proximal end of the first member of the second linkage subassembly, with the second piston providing a second force.

In an embodiment including a first linkage subassembly and second linkage subassembly, when a user moves the front door from the closed position to the open position, the first force provided by the first piston, in combination with the first linkage subassembly, as well as the second force provided by the second piston, in combination with the second linkage subassembly, collectively create a torque that partially offsets a weight of the front door, such that the first and second pistons effectively assist the user in moving the front door from the closed position to the open position.

One of ordinary skill in the art will recognize that additional embodiments are possible without departing from the teachings of the present invention. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. A front door assembly for a beverage dispenser, comprising:

a front door pivotally connected to a cabinet of the beverage dispenser, the front door being movable between a closed position and an open position relative to the cabinet;

a linkage subassembly, including a first member having a distal end pivotally connected to the cabinet of the beverage dispenser and a proximal end opposite the distal end, and a second member having a distal end pivotally connected to the front door and a proximal end opposite the distal end, the proximal end of the second member pivotally connected to the first member at a position intermediate the distal end and the proximal end of the first member; and a piston pivotally connected to and extending between the front door and the proximal end of the first member, the piston providing a force;

wherein, when a user moves the front door from the closed position to the open position, the force provided by the piston, in combination with the linkage subassembly, creates a torque that partially offsets a weight of the front door, such that the piston effectively assists the user in moving the front door from the closed position to the open position.

2. The front door assembly as recited in claim 1, wherein, when the front door is in the open position, the force provided by the piston, in combination with the linkage subassembly, creates a torque that fully offsets the weight of the front door, such that the piston maintains the front door in the open position.

3. The front door assembly as recited in claim 1, wherein the first member comprises:

a first portion that includes the proximal end of the first member;

a second portion that includes the distal end of the first member; and an angled portion connecting the first portion of the first member and the second portion of the first member, such that the second portion of the first member is parallel to the first portion of the first member but is not in the same plane as the first portion of the first member.

4. The front door assembly as recited in claim 3, wherein the proximal end of the second member is pivotally connected to the first portion of the first member, such that the second member is in substantially the same plane as the second portion of the first member.

5. The front door assembly as recited in claim 1, wherein, when the front door is in the closed position, the first member extends downward and away from the cabinet at a predetermined acute angle relative to the cabinet, and, when the front door is in the open position, the first member extends upward and away from the cabinet at a predetermined obtuse angle relative to the cabinet.

6. The front door assembly as recited in claim 5, wherein, as a result of the movement of the first member from the predetermined acute angle to the predetermined obtuse angle, the second member moves from an initial acute angle relative to the front door to a final acute angle relative to the front door that is larger than the initial acute angle.

7. The front door assembly as recited in claim 1, wherein when the front door is in the closed position, the piston extends substantially parallel to the front door.

8. The front door assembly as recited in claim 1, wherein when the front door is in the open position, the piston is oriented at an angle of about 20° or less relative to the front door.

9. The front door assembly as recited in claim 1, and further comprising a hinge directly connecting the front door to a top panel of the cabinet, such that the front door is moveable between the closed position and the open position, wherein, when the front door is in the closed position, the front door is in a substantially vertical orientation, and, when the front door is in the open position, the front door is in a substantially horizontal orientation.

10. A front door assembly for a beverage dispenser, comprising:

a front door pivotally connected to a cabinet of the beverage dispenser, the front door being movable between a closed position and an open position relative to the cabinet;

a linkage subassembly, including a first member having a distal end pivotally connected to the cabinet of the beverage dispenser and a proximal end opposite the distal end, and a second member having a distal end pivotally connected to the front door and a proximal end opposite the distal end, the proximal end of the second member pivotally connected to the first member at a position intermediate the distal end and the proximal end of the first member; and a piston pivotally connected to and extending between the front door and the proximal end of the first member, the piston providing a force;

wherein, when the front door is in the closed position, the second member is oriented at an initial angle relative to the front door, and, when the front door is in the open position, the second member is oriented at a final angle relative to the front door that is larger than the initial angle, the initial angle and the final angle both being acute angles opening towards a bottom of the front door; and wherein, when a user moves the front door from the closed position to the open position, the force provided by the piston, in combination with the linkage subassembly, creates a torque that partially offset a weight of the front door, such that the position effectively assists the user in moving the front door from the closed position to the open position.

11. A front door assembly for a beverage dispenser, comprising:

a front door pivotally connected to a cabinet of the beverage dispenser, the front door being movable between a closed position and an open position relative to the cabinet;

a first linkage subassembly positioned adjacent to a first side of the front door, the first linkage subassembly including a first member having a distal end pivotally connected to the cabinet of the beverage dispenser and a proximal end opposite the distal end, and a second member having a distal end pivotally connected to the front door and a proximal end opposite the distal end, the proximal end of the second member pivotally connected to the first member of the first linkage subassembly at a position intermediate the distal end and the proximal end of the first member of the first linkage subassembly; and a first piston pivotally connected to and extending between the front door and the proximal end of the first member of the first linkage subassembly, the first piston providing a first force;

a second linkage subassembly positioned adjacent to a second side of the front door, the second linkage subassembly including a first member having a distal end pivotally connected to the cabinet of the beverage dispenser and a proximal end opposite the distal end, and a second member having a distal end pivotally connected to the front door and a proximal end opposite the distal end, the proximal end of the second member pivotally connected to the first member of the second linkage subassembly at a position intermediate the distal end and the proximal end of the first member of the second linkage subassembly; and a second piston pivotally connected to and extending between the front door and the proximal end of the first member of the second linkage subassembly, the second piston providing a second force;

wherein, when a user moves the front door from the closed position to the open position, the first force provided by the first piston, in combination with the first linkage subassembly, as well as the second force provided by the second piston, in combination with the second linkage subassembly, create a torque that partially offsets a weight of the front door, such that the first and second pistons effectively assist the user in moving the front door from the closed position to the open position.

12. The front door assembly as recited in claim 11, and further comprising a hinge directly connecting the front door to a top panel of the cabinet, such that the front door is moveable between the closed position and the open position, wherein, when the front door is in the closed position, the front door is in a substantially vertical orientation, and, when the front door is in the open position, the front door is in a substantially horizontal orientation.

13. A beverage dispenser, comprising:

a cabinet;

one or more beverage dispensing units enclosed in the cabinet;

a front door pivotally connected to the cabinet, the front door being movable between a closed position and an open position relative to the cabinet;

a linkage subassembly, including a first member having a distal end pivotally connected to the cabinet and a proximal end opposite the distal end, and a second member having a distal end pivotally connected to the front door and a proximal end opposite the distal end, the proximal end of the second member pivotally connected to the first member at a position intermediate the distal end and the proximal end of the first member; and a piston pivotally connected to and extending between the front door and the proximal end of the first member, the piston providing a force;

wherein, when a user moves the front door from the closed position to the open position, the force provided by the piston, in combination with the linkage subassembly, creates a torque that partially offsets a weight of the front door, such that the piston effectively assists the user in moving the front door from the closed position to the open position.

14. The beverage dispenser as recited in claim 13, wherein the first member of the linkage subassembly comprises:

a first portion that includes the proximal end of the first member;

a second portion that includes the distal end of the first member; and an angled portion connecting the first portion of the first member and the second portion of the first member, such that the second portion of the first member is parallel to the first portion of the first member but is not in the same plane as the first portion of the first member.

15. The beverage dispenser as recited in claim 14, wherein the proximal end of the second member of the linkage subassembly is pivotally connected to the first portion of the first member, such that the second member is in substantially the same plane as the second portion of the first member.

16. The beverage dispenser as recited in claim 13, wherein, when the front door is in the closed position, the first member of the linkage subassembly extends downward and away from the cabinet at a predetermined acute angle relative to the cabinet, and, when the front door is in the open position, the first member extends upward and away from the cabinet at a predetermined obtuse angle relative to the cabinet.

17. The beverage dispenser as recited in claim 13, wherein when the front door is in the closed position, the piston extends substantially parallel to the front door.

18. The beverage dispenser as recited in claim 13, wherein when the front door is in the open position, the piston is oriented at an angle of about 20° or less relative to the front door.

19. The beverage dispenser as recited in claim 13, and further comprising a hinge directly connecting the front door to a top panel of the cabinet, such that the front door is moveable between the closed position and the open position, wherein, when the front door is in the closed position, the front door is in a substantially vertical orientation, and, when the front door is in the open position, the front door is in a substantially horizontal orientation.

20. A beverage dispenser, comprising:

a cabinet;

one or more beverage dispensing units enclosed in the cabinet;

a front door pivotally connected to the cabinet, the front door being movable between a closed position and an open position relative to the cabinet;

a linkage subassembly, including a first member having a distal end pivotally connected to the cabinet and a proximal end opposite the distal end, and a second member having a distal end pivotally connected to the front door and a proximal end opposite the distal end, the proximal end of the second member pivotally connected to the first member at a position intermediate the distal end and the proximal end of the first member; and a piston pivotally connected to and extending between the front door and the proximal end of the first member, the piston providing a force;

wherein, when the front door is in the closed position, the second member of the linkage subassembly is oriented at an initial angle relative to the front door, and, when the front door is in the open position, the second member is oriented at a final angle relative to the front door that is larger than the initial angle, the initial angle and the final angle both being acute angles opening towards a bottom of the front door; and wherein, when a user moves the front door from the closed position to the open position, the force provided by the piston, in combination with the linkage subassembly, creates a torque that partially offsets a weight of the front door, such that the piston effectively assists the user in moving the front door from the closed position to the open position.

* * * * *